US007390268B2

(12) United States Patent
Merriman

(10) Patent No.: US 7,390,268 B2
(45) Date of Patent: Jun. 24, 2008

(54) GOLF BALL RETRIEVAL AND POSITIONING SYSTEM

(75) Inventor: Joel Merriman, White Lake, MI (US)

(73) Assignee: Touch Golf Products, Waterford, MI (US)

( * ) Notice: Subject to any disclaimer, the term of this patent is extended or adjusted under 35 U.S.C. 154(b) by 51 days.

(21) Appl. No.: 11/384,661

(22) Filed: Mar. 20, 2006

(65) Prior Publication Data

US 2007/0219012 A1 Sep. 20, 2007

(51) Int. Cl.
*A63B 47/02* (2006.01)
*A63B 57/00* (2006.01)

(52) U.S. Cl. ..... 473/286; 473/387; 473/401; 294/19.2

(58) Field of Classification Search ..... 473/286, 473/284, 394–403, 387; 294/19.2
See application file for complete search history.

(56) References Cited

U.S. PATENT DOCUMENTS

| | | | | |
|---|---|---|---|---|
| 4,313,604 | A | 2/1982 | Baxter | |
| 5,328,174 | A | 7/1994 | Reeder | |
| D377,817 | S | 2/1997 | Huber | |
| 5,772,533 | A | 6/1998 | Dahlmann | |
| 5,839,972 | A * | 11/1998 | Swanson | 473/286 |
| 6,159,108 | A | 12/2000 | De la Pena | |
| 6,254,497 | B1 | 7/2001 | Brant et al. | |
| 6,638,177 | B1 | 10/2003 | Wang | |
| 6,749,522 | B1 | 6/2004 | Aikman | |
| D497,656 | S | 10/2004 | Maraschiello | |
| 6,817,955 | B2 | 11/2004 | O'Donnell et al. | |
| 6,878,071 | B1 | 4/2005 | Schwieger et al. | |
| 6,899,635 | B2 | 5/2005 | Nadratowski et al. | |
| 2002/0193183 | A1 | 12/2002 | Aikman | |
| 2003/0083142 | A1 | 5/2003 | Nam | |
| 2003/0092498 | A1 * | 5/2003 | Jaramillo, Jr. | 473/285 |
| 2005/0014572 | A1 | 1/2005 | Lisby, Jr. | |
| 2005/0170904 | A1 | 8/2005 | Smeeth | |
| 2006/0058109 | A1 * | 3/2006 | Wilson, III | 473/286 |

OTHER PUBLICATIONS

*The Pick-it-Up*, available at http://www.easiergolfing.com (Nov. 15, 2005), 2 pages.

*Upright* Golf.com:Products, available at http://www.uprightgolf.com/upright_golf_products.html (Dec. 6, 2005), 8 pages.

*Flex Tee*, available at http://www.flextee.net/whyflexteel.php (Dec. 6, 2005), 6 pages.

(Continued)

*Primary Examiner*—Stephen Blau
(74) *Attorney, Agent, or Firm*—Alston & Bird LLP

(57) ABSTRACT

Various embodiments of the present invention are directed to an improved golf ball retrieval and positioning device. Unlike other anti-bend golf products, the golf ball retrieval and positioning system of various embodiments of the present invention includes a golf ball positioning device and a golf ball retrieval device that also functions as a base for supporting a golf ball in a teeing position. The components of the present invention are modular and interface with an existing golf club through a hole that exists in the end of a golf club grip. As a result, the present invention provides an improved system for teeing and retrieving golf balls without having to bend over. The system is inexpensive, easily portable, and non-damaging to the golf club.

12 Claims, 15 Drawing Sheets

OTHER PUBLICATIONS

*JimPeteo Putters*, available at http://www.jimpeteo.com (Dec. 6, 2005), 2 pages.
*Bogeys and Birdies—WA*, available at http://bogeysandbirdies.com/catalog_detail.php?ProdID=2923&ProdC . . . (Dec. 6, 2005), 1 page.
*Upright Golf Stick with Joes Original Back Tee*, available at http://www.innovagolf.com/upgostwijoor.html (Dec. 6, 2005), 2 pages.
*Tee Up Without Bending with EZT*, available at http://www.shop-safely.com/shops.asp?shop=shegolfs&pid=EZT2 (Dec. 6, 2005) 4 pages.
*Kool Tee—Golf Teeing Equipment* available at http://www.kool-te.com/ (Dec. 6, 2005), 2 pages.
*Joe's Original BACKTEE™*, available at http://www.supersizeworld.com/18-800.htm (Dec. 6, 2005), 3 pages.
*Upright Golf Stick*, available at http://www.supersizeworld.com/18-810.htm (Dec. 6, 2005), 4 pages.
*The Tee Stick*, available at http://www.teestick.com/ (Dec. 6, 2005), 3 pages.
*EZ-Tee*, available at http://www.ez-tee.net/ezt.html (Dec. 6, 2005) 2 pages.
*EZ-Tee and EZ-Putter*, available at http://www.ez-tee.net/index.html (Dec. 6, 2005), 4 pages.
EasierGolfing.com, available at http://64.233.1790.104/search?q=cache:Mq2VTb9TprAJ:www.easiergo . . . (Dec. 6, 2005), 2 pages.
*EZ-Putter*, available at http://www.ez-tee.net/ezp.html (Dec. 6, 2005) 2 pages.
*Teerific! Enjoy a higher level of play*, available at http://home/pacbell.net/teerific/ (Dec. 6, 2005) 2 pages.
*Kool Tee™*; 4 pages; available at <http://www.kool-tee.com> (visited Dec. 6, 2005).
*The Pick-it-Up*, available at http://www.easiergolfing.com/_pick-it-up (Nov. 15, 2005), 4 pages.
GBR1 Golf Ball Retreiver; Golfing Accessories @ Promotional Choice Ltd.; available at <http://a5.zencatalog.com/promotional2/gbrl_golfball_retriever>; (Aug. 28, 2007), 4 selected pages.

* cited by examiner

GOLF BALL RETRIEVAL AND POSITIONING SYSTEM

BACKGROUND OF THE INVENTION

1. Field of the Invention

This invention relates generally to golf accessories, and in particular, to accessories that allow a golfer to tee and position golf balls and other objects without bending over.

2. Description of the Related Art

The game of golf is one of the most popular forms of recreation in the United States and throughout the world. Golf is marketed as a game that can be enjoyed throughout one's lifetime. However, in practice, many golfers are forced to give up golf prematurely due to the strain and pressure that the game places on one's back and joints. Much of this strain and pressure results from the fact that golfer's are constantly required to bend over and manipulate items adjacent their feet during a round. For example, golfers must bend over to tee a golf ball before beginning a hole, mark or clean a golf ball on the green, and retrieve a golf ball from a cup after completion of the hole. In a typical 18-hole golf round a golfer may be forced to bend completely over a total of seventy times.

A few products have emerged in recent years that purport to alleviate the above back pressure and strain by allowing a golfer to tee or pick up a golf ball from a relatively upright position (i.e., without bending over). Such products, however, have proven less than desirable as they are generally expensive, cumbersome to carry and use, and may result in limiting the effectiveness of traditional golf clubs.

For example, one prior art device requires that a golfer carry, in addition to his/her fourteen golf clubs, a telescoping golf retrieval and placement device that is akin to a telescoping golf ball retriever commonly used to retrieve a golf ball from water or other hazards. Such devices typically include an elongate or telescoping pole and a pick-up tool disposed on one end thereof. In various applications, the pick-up tool is designed to hold the golf ball securely such that it may be retrieved without being dislodged as the pick-up tool bumps seaweed, mud, brush, or other objects that are common to golf hazards. Unfortunately, however, such golf ball retrieval and placement devices are expensive, cumbersome to carry and operate, and must be carried in an already tightly packed golf bag. Other prior art golf ball retrieval and placement devices incorporate pick-up tools that are attached to the hozzle of a golf club or that clip over the golf club grip. Such devices also have drawbacks in that they are generally cumbersome to use and limit the effectiveness of the golf clubs themselves. For example, pick-up tools that are clipped over the grip of a golf club may cause undue wear and tear to the grip.

As a result, there is a need for an improved system and method for simply positioning and retrieving golf balls without requiring a golfer to significantly bend at the waist. The improved system and method should be inexpensive, compact, easy to use, and should operate as a non-damaging accessory to a conventional golf club.

BRIEF SUMMARY OF THE INVENTION

The above needs are addressed and other advantages are provided by an improved golf ball retrieval and positioning system. Unlike other anti-bend golf products, the golf ball retrieval and positioning system of various embodiments of the present invention includes a golf ball positioning device and a golf ball retrieval device that also functions as a base for supporting a golf ball in a teeing position. The components of the present invention are modular and interface with an existing golf club through a hole that exists in the end of a golf club grip. As a result, the present invention provides an improved system for teeing and retrieving golf balls without having to bend over. The system is inexpensive, easily portable, and non-damaging to the golf club.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
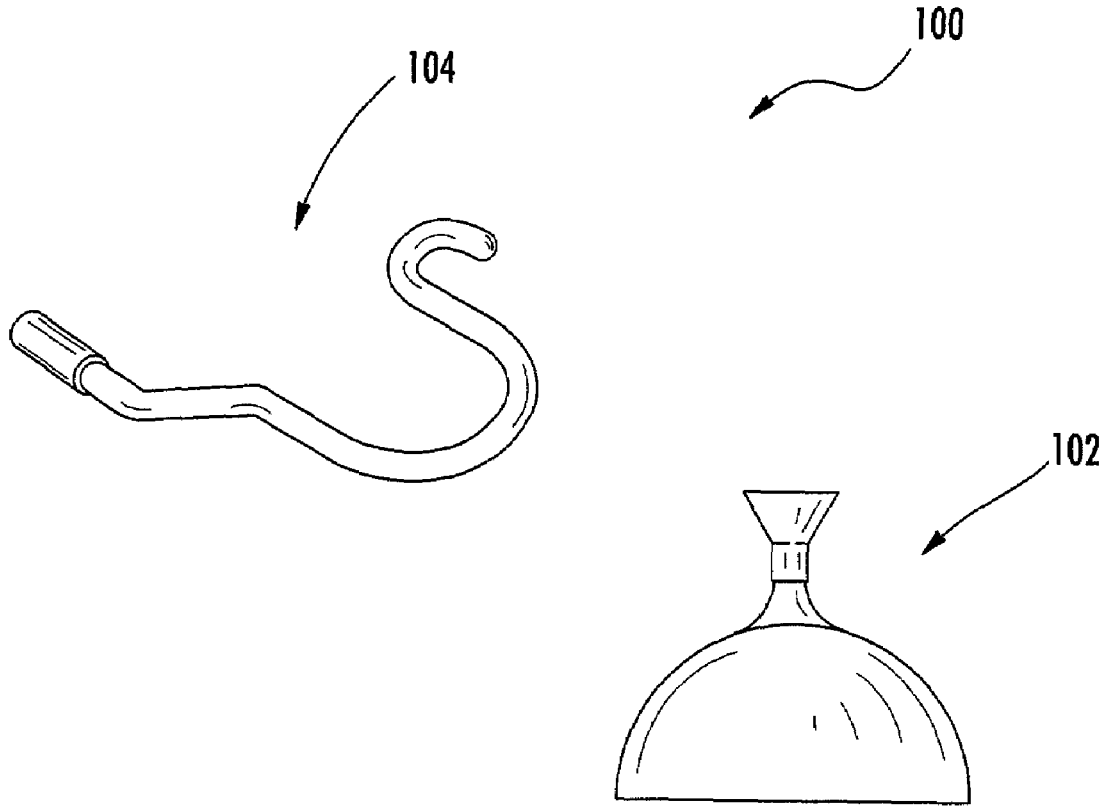
FIG. 1 depicts an improved golf ball retrieval and positioning system in accordance with one embodiment of the present invention.

FIG. 1 shows a golf ball retrieval and positioning system in accordance with one embodiment of the present invention. The depicted golf ball retrieval and positioning system 100 comprises a retrieval and teeing device 102 and a positioning device 104. As will be described in more detail below, the depicted golf ball retrieval and positioning system 100 may be simply used by a golfer, without significantly bending over at the waist, to tee-up a golf ball prior to driving, manipulate a golf ball, golf marker, or other object on or proximate to the ground (e.g., golf green, tee box, fairway, etc.), fix or repair a divot or ball mark (i.e., indentation made by the ball upon landing on the green or fairway) and retrieve a golf ball from a cup upon completion of a golf hole. Finally, the depicted golf ball retrieval and positioning system 100 allows a golfer to accurately, and cheaply mark a putting reference line to a golf ball as will be discussed in greater detail below.

Various components of the depicted golf ball retrieval and positioning system 100 are structured to removably attach to a conventional golf club grip thereby allowing a golfer to use the length of the golf club to pick-up or otherwise manipulate golf balls and other objects on the ground without substantially bending over. Multiple additional golf-related uses for various embodiments of the present invention will be apparent to one of ordinary skill in the art in view of the disclosure provided below.

Figure 2:
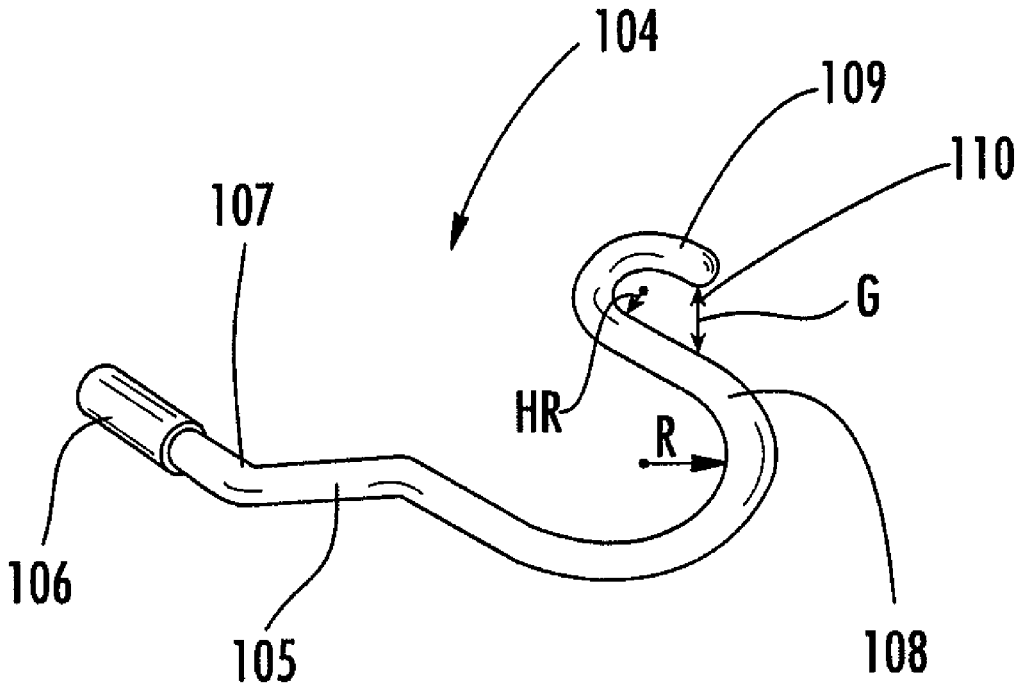
FIG. 2 is a perspective view of a golf ball positioning device in accordance with one embodiment of the present invention.

FIG. 2 depicts a positioning device 104 structured in accordance with one embodiment of the present invention. The depicted positioning device 104 comprises an interface portion 106, a transition portion 105, a cradle portion 108 and a hook portion 110 as shown. The interface portion 106 is disposed at a first end 107 of the positioning device 104 and is adapted for attachment to a conventional golf grip as described in reference to FIG. 3 below. The transition portion 105 provides a structural transition between the interface portion 106 and the cradle portion 108 and defines the position of the cradle portion 108 relative to the golf club as will be described in greater detail below.

The cradle portion 108 is structured to receive and manipulate a golf ball. In the depicted embodiment, the cradle portion 108 defines a curved member that extends from the transition portion 105 to the hook portion 110. In one embodiment, the cradle portion 108 defines a radius R that is sized to partially enclose a golf ball below its widest part. In various embodiments the cradle portion radius R is preferably less than 0.84 inches, more preferably between 0.82 and 0.55 inches, and still more preferably between 0.78 and 0.60 inches. In another embodiment, the cradle portion 108 partially encloses a golf ball by encircling less than 90 percent of its circumference, more preferably between 55 and 90 percent of its circumference, and still more preferably between 60 and 75 percent of the golf ball's circumference.

Figure 11:
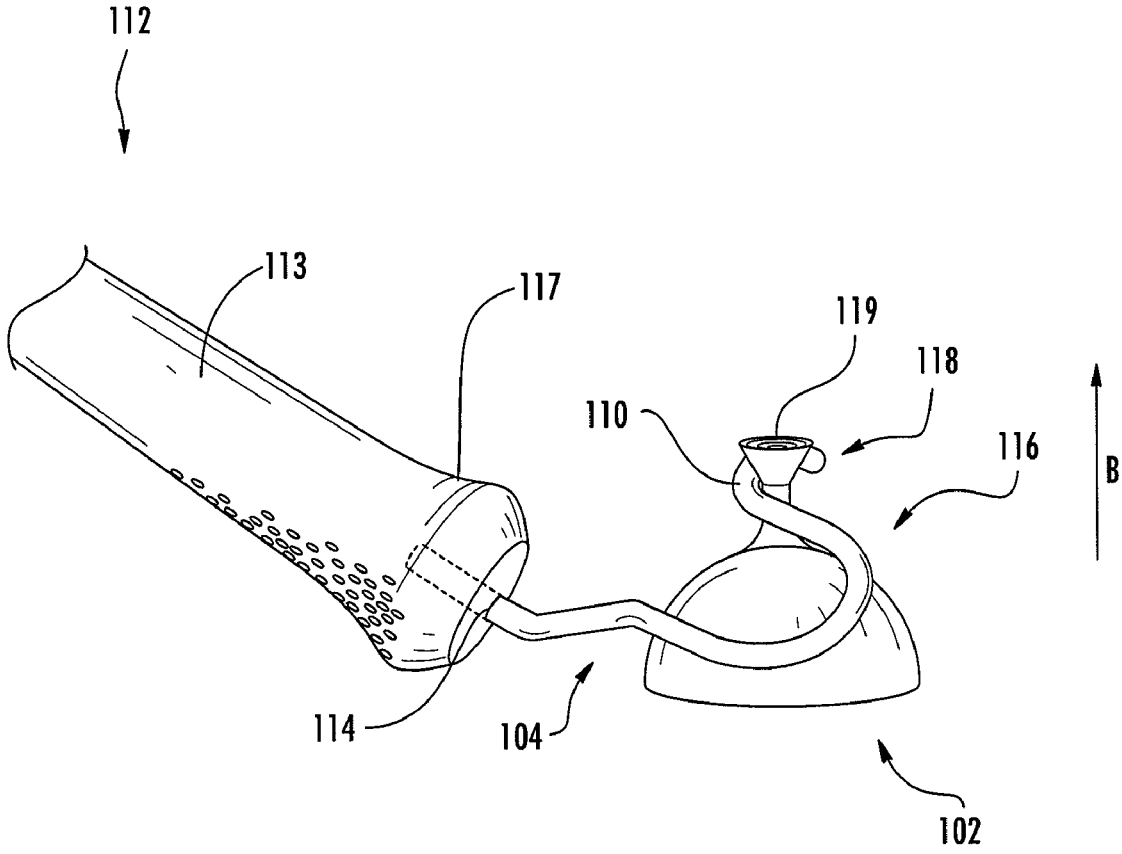
FIG. 11 is a perspective view of a golf ball positioning device inserted into the grip of a golf club and being used to retrieve a golf ball retrieval and teeing device in accordance with one embodiment of the present invention.

The cradle portion 108 terminates at the hook portion 110 that is structured proximate a second end 109 of the positioning device 104 as shown. The hook portion 110 is a curved member extending outwardly from the cradle portion 108 in a direction opposite to that of the cradle portion curve as shown. The hook portion 110 is structured to pick up and otherwise manipulate a variety of objects including but not limited to the retrieval and teeing device 103 (as shown in FIG. 11) and a washer-shaped golf ball marker (depicted as item 195 of FIG. 12). In one embodiment, the hook portion 110 defines a hook radius HR that is sized to at least partially enclose a golf tee head below its widest part. In various embodiments the hook radius HR is preferably less than 0.2188 inches, more preferably between 0.0938 and 0.2188 inches, and still more preferably between 0.15 and 0.2188 inches. In another embodiment, the hook portion 110 defines a gap G that is sized to laterally receive a golf tee or other object. In various embodiments, the gap G is greater than 0.1875 inches, more preferably between 0.19 and 0.30 inches, and still more preferably between 0.20 and 0.25 inches.

Positioning devices 104 according to various embodiments of the present invention may be comprised of a variety of materials including metals, polymers, rubbers, composite materials, natural materials such as wood, or any other material that is capable of being formed or molded into a desired shape and that is capable of holding its shape under the weight of a golf ball or other positionable object. The depicted positioning device 104 is comprised of a formed metal wire. Positioning devices 104 according to various embodiments may be produced from a single material as shown or alternatively, from multiple materials. For example, in one embodiment, the interface portion 106 may be formed from a first material, the transition portion 105 may be formed from a second material, and the cradle portion 108 and hook portion 110 may be formed from a third material.

Figure 3:
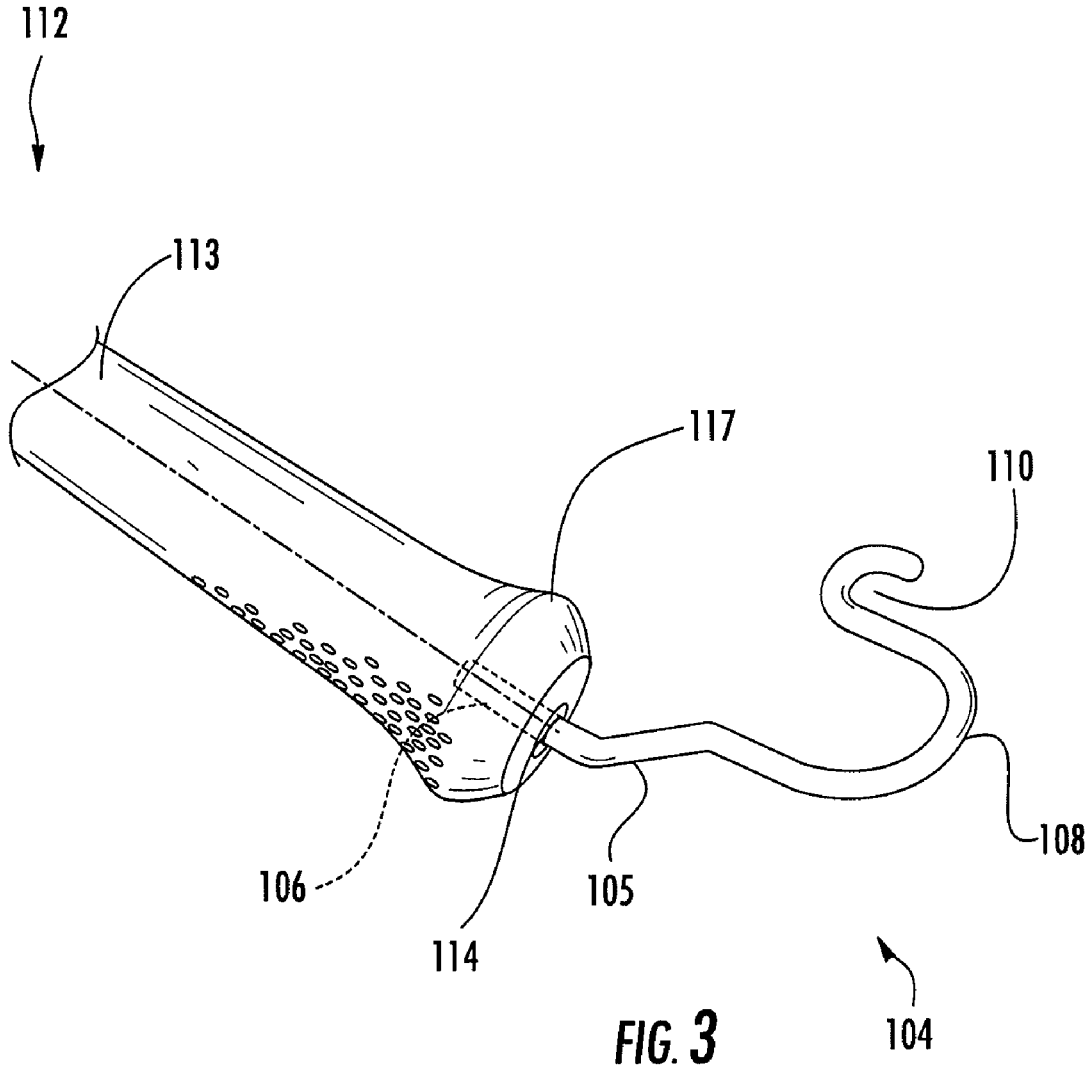
FIG. 3 is a perspective view of a golf ball positioning device inserted into the grip of a golf club in accordance with one embodiment of the present invention.

FIG. 3 depicts a positioning device 104 attached to a golf club 112 in accordance with one embodiment of the present invention. More particularly, the interface portion 106 of the depicted positioning device 104 has been inserted into an air relief hole 114 (also referred to herein as a golf grip hole) of a conventional golf club grip 113. As will be apparent to one of ordinary skill in the art, air relief holes 114 are commonly defined in conventional golf grips to assist grip installation by allowing trapped air to escape from the grip 113 as it is pushed onto a golf club shaft (not shown). Various embodiments of the present invention take advantage of this standard golf grip feature by providing a positioning device 104 having an interface portion 106 that is structured to be removably received by the grip hole 114. When inserted into the golf grip hole 114, the positioning device 104 is sufficiently supported such that it may used to carry or manipulate a golf ball 111 or other objects. In the depicted embodiment, the interface portion 106 is sized such that it produces an interference fit within the grip hole 114. For example, in one embodiment, at least part of the interface portion may define a diameter between 0.09 and 0.1875 inches, preferably approximately 0.125 inches.

In another embodiment, the interface portion 106 may be tapered (not shown) to ensure an adequate interference fit. In yet another embodiment, the interface portion 106 may define one or more ribs (not shown) that may be pressed through the resilient golf grip hole 114 to maintain the interface member 106 within the golf grip hole 114 until removed by a user. In still other embodiments, the interface portion 106 may be removably received by the grip hole 114 in various additional ways, for example, the interface portion 106 may define one or more screw type threads (not shown) such that the positioning device 104 may be removably screwed into the grip hole 114.

Figure 3A:
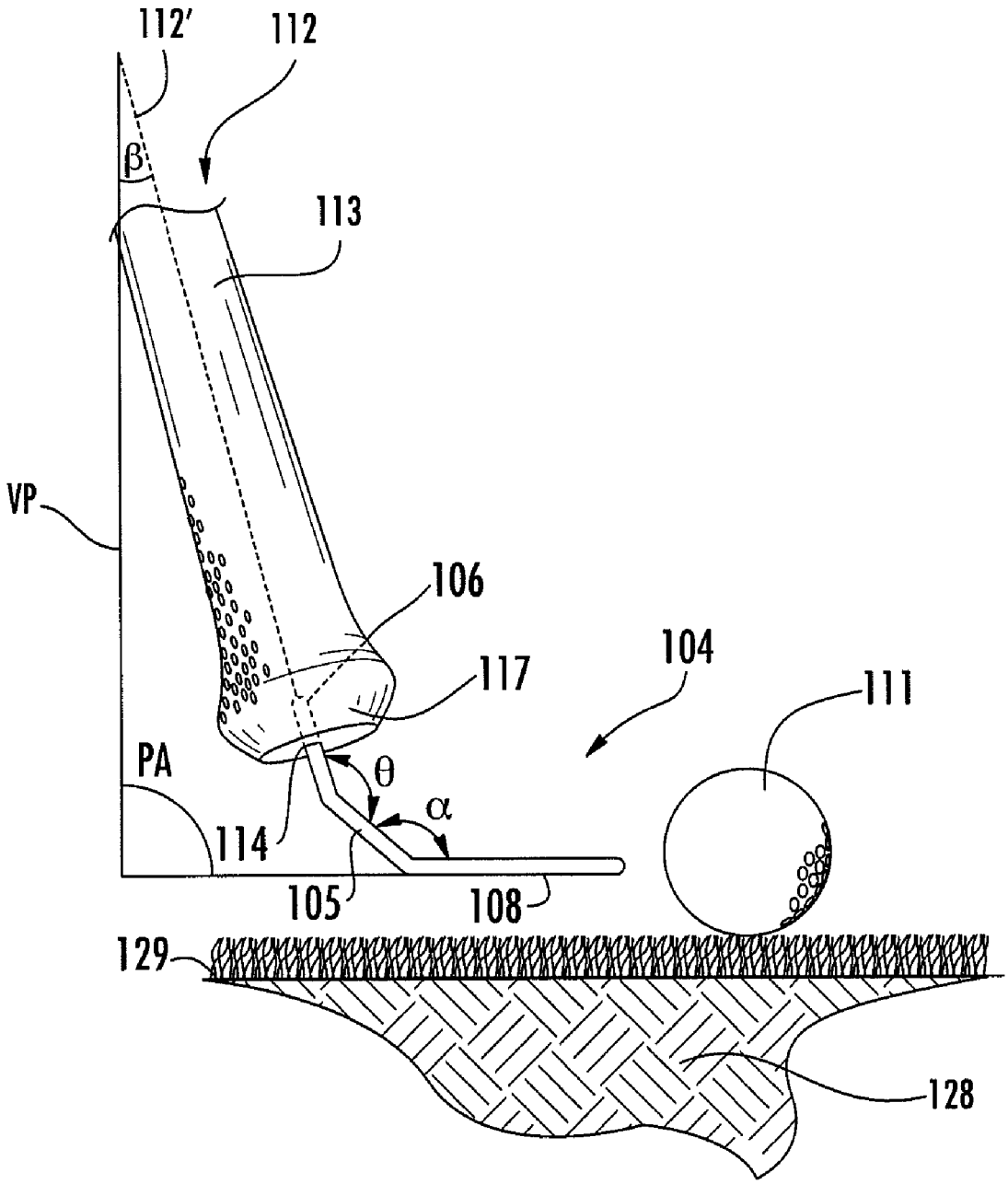

The positioning device 104 depicted in FIG. 3A defines a first transitional angle $\theta$ between the interface portion 106 and the transition portion 105. A second transition angle $\alpha$ is defined between the transition portion 105 and the cradle portion 108 as shown. An address angle $\beta$ is defined between the longitudinal axis 112' of the golf club 112 and a vertical plane VP that is illustrated in FIG. 3 to generally represent the plane of a user's stance. In one embodiment, the address angle $\beta$, the first transition angle $\theta$, and the second transition angle $\alpha$ may be added to define a pick angle PA between 70 and 120 degrees, preferably between 80 and 110 degrees, and more preferably between 85 and 105 degrees. In other embodiments, the transition portion 105 of the positioning member 104 may be omitted such that the interface member 106 extends directly into the cradle portion 108 (not shown) thereby defining a single transition angle (not shown). In such embodiments, the address angle β and the single transition angle (not shown) may be added to define a pick angle PA between 70 and 120 degrees, preferably between 80 and 110 degrees, and more preferably between 85 and 105 degrees. In still other embodiments, hinges, flexible wires, or other bendable materials may be used for one or more parts of the positioning device 106 such that at least one of the address angle β, the first transition angle θ, the second transition angle α, and the pick angle PA may be adjusted to hold a desired angle that is selected from among a range of angles to meet a specific application.

Figure 4:
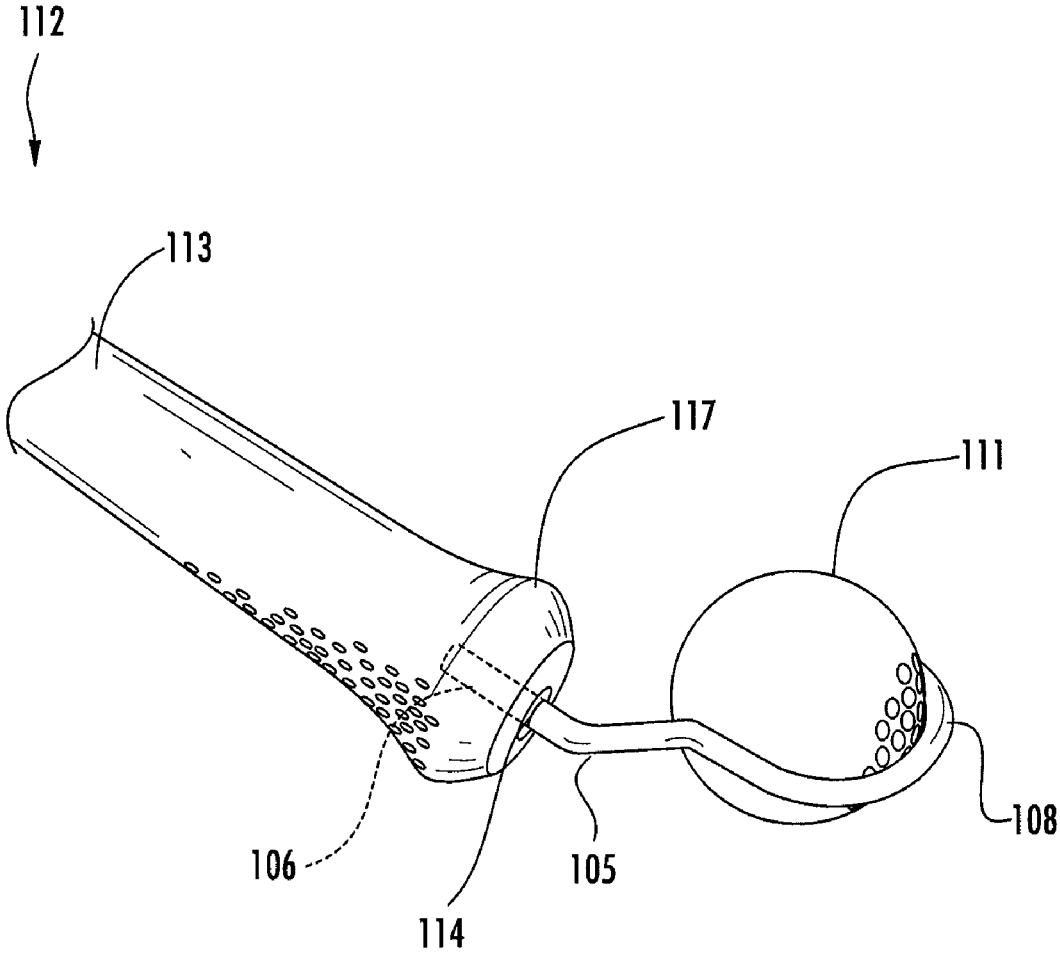
FIG. 4 is a perspective view of a golf ball positioning device cradling a golf ball in accordance with one embodiment of the present invention.

FIG. 4 depicts a positioning device 104 supporting a golf ball 111 cradled atop its cradle portion 108 in accordance with one embodiment of the present invention. As will be apparent to one of ordinary skill in the art, a golf ball defines a maximum width or diameter generally adjacent to its equator. In the depicted embodiment, the cradle portion 108 of the positioning device is sized to partially enclose the golf ball 111 immediately below its equator as shown. In this regard, positioning devices 104 structured in accordance with various embodiments of the present invention may be used in combination with a standard golf club to pick up and manipulate or position a golf ball or other object without bending over. It should be noted that in various embodiments, the term "positioning" refers to picking up a golf ball or other object from the ground, moving a golf ball or other object from one location to another, placing a golf ball or other object in a desired location (e.g., on a tee or teeing support), removing a golf ball or other object from a desired location (e.g., from a golf cup), and various other movements.

Figure 5:
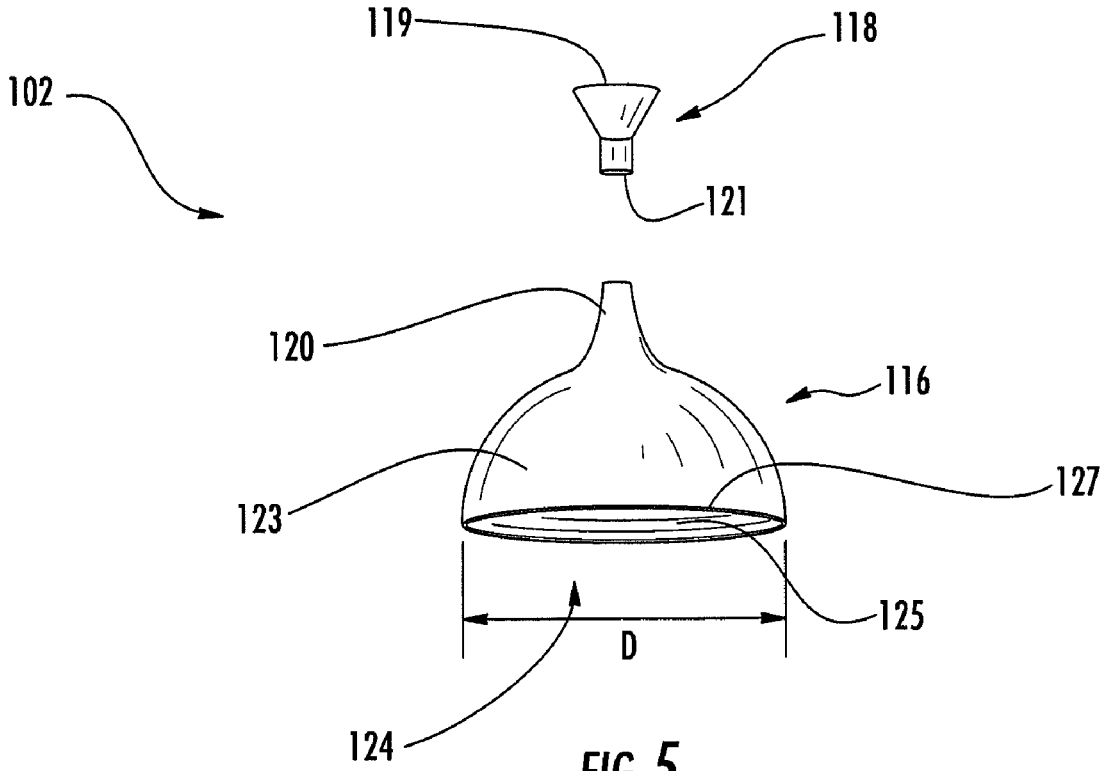
FIG. 5 is an exploded view of a golf ball retrieval and teeing device in accordance with one embodiment of the present invention.

FIG. 5 depicts a retrieval and teeing device 102 structured in accordance with one embodiment of the present invention. The depicted retrieval and teeing device 102 is structured to have a dual use as a golf ball retrieving aid and a golf ball teeing aid. Said differently, retrieval and teeing devices structured in accordance with various embodiments of the present invention may be used in a retrieval mode and/or a teeing mode. The retrieval and teeing device 102 includes a retrieval portion 116, an interface portion 120, and a teeing portion 118 as shown. In various embodiments, the teeing portion 118 is removably secured to the interface portion 120 and is structured to support a golf ball in a teed position. In this regard, the teeing portion 118 defines a cavity 121 at a first end for receiving the interface portion 120 and a concave teeing surface 119 proximate a second end that is similar to a teeing surface commonly associated with a conventional golf tee. It should be noted, however, that in various other embodiments, the teeing surface 119 may have any configuration that is sufficient to support a golf ball 111 in a teed position, including, but not limited to, a vertically extending cylinder or ring, multiple vertically extending fingers or brushes, or other similar tee configurations that may be apparent to one of ordinary skill in the art.

In the depicted embodiment, the retrieval portion 116 of the retrieval and teeing device 102 is structured generally as an inverted cup or shell for removably receiving at least a portion of a golf ball. In this regard, the depicted retrieval portion 116 defines a diameter D that is sized to partially enclose a golf ball above its widest part. In various embodiments the retrieval portion diameter D is preferably less than 1.680 inches, more preferably between 1.64 and 1.10 inches, and still more preferably between 1.56 and 1.20 inches. The depicted retrieval portion 116 is comprised of a polymer shell that is structured to fit snugly over at least a portion of a golf ball. The shell defines an outer surface 123, an inner surface 125, a cavity 124, and a peripheral edge 127. In various embodiments, the inner surface 125 and/or peripheral edge 127 of the retrieval portion 116 form an interference fit around the perimeter of a golf ball when the ball is pressed snugly into the cavity 124 as discussed in greater detail below.

Figure 6:
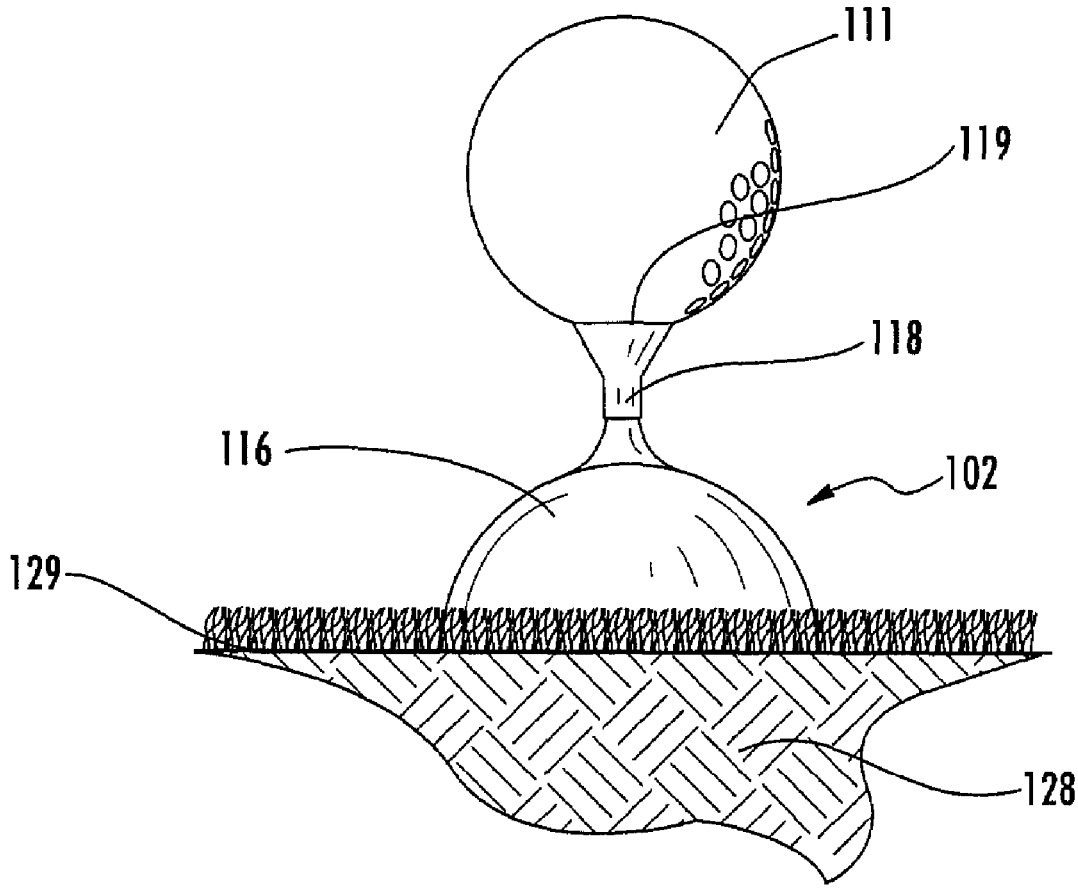
FIG. 6 is a front view of a golf ball retrieval and teeing device supporting a golf ball in a teeing position in accordance with one embodiment of the present invention.

As shown in FIG. 6, the retrieval and teeing device 102 may be used as a golf ball teeing aid. During use, the depicted retrieval portion 116 is placed on the ground 128 such that its peripheral edge 127 rests proximate the ground surface 129 as shown. As noted above, the teeing portion 118 is structured to receive the interface portion 120, which extends from the outer surface 123 of the retrieval portion 116. The interface portion 120 is sized to produce a sliding interference fit within the cavity (item 121 of FIG. 5) defined proximate the first end of the teeing portion 118. In this regard, the teeing portion 118 is removably secured to the retrieval portion 116. When so configured, the retrieval and teeing device 102 may be used by a golfer to support a golf ball 111 in a teed position as shown.

In the depicted embodiment, the teeing portion 118, the interface portion 120, and the retrieval portion 116 of the retrieval and teeing device 102 are constructed of a molded polymer such as polypropylene; however, in various embodiments of the present invention the teeing portion 118, the interface portion 120, and the retrieval portion 116 may be constructed of any durable material having the flexibility, strength and rigidity to support a golf ball such as plastic materials, rubber materials, composites, and combinations thereof.

Figure 7:
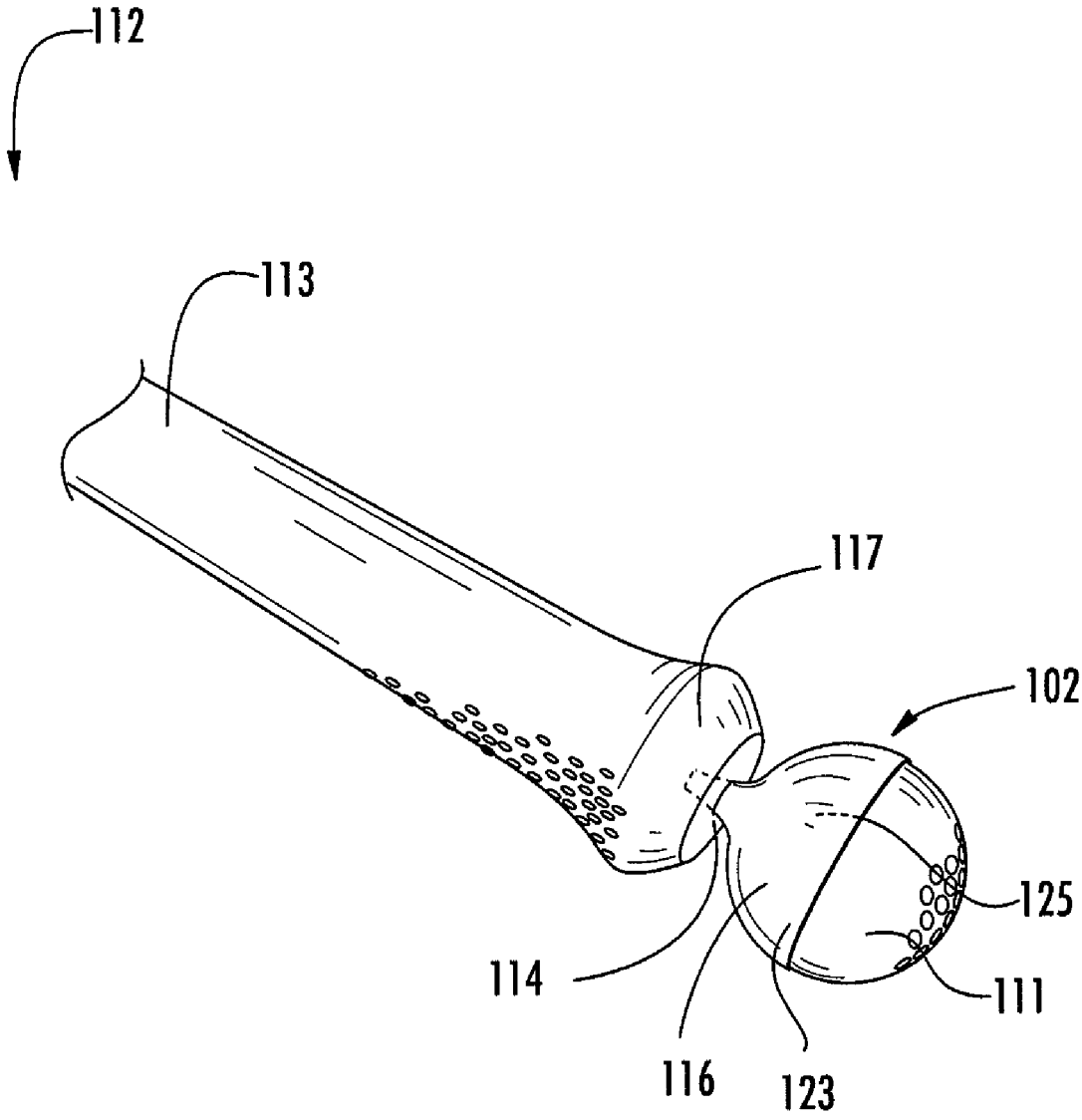
FIG. 7 is a perspective view of a golf ball retrieval and teeing device inserted into the grip of a golf club and receiving a golf ball in accordance with one embodiment of the present invention.

As noted above and illustrated in FIG. 7, the retrieval and teeing device 102 may also be used as a golf ball retrieving aid simply by removing the teeing portion (not shown). In the depicted embodiment, the interface portion 120 of the retrieval and teeing device 102 is structured to be received by an air relief hole 114 similar to that described with regard to FIGS. 3-4 above. When inserted into the golf grip hole 114, the retrieval portion 116 is sufficiently supported such that it may used to carry or manipulate a golf ball 111 or other objects. In the depicted embodiment, the interface portion 120 is sized such that it produces an interference fit within the air relief hole 114. In another embodiment, the interface portion 120 may be tapered (not shown) to ensure an adequate interference fit. In yet another embodiment, the interface portion 120 may define one or more ribs (not shown) that may be pressed through the resilient golf grip hole 114 to maintain the interface member 120 within the golf grip hole 114 until removed by a user. In such embodiments, corresponding ribs or holes may be defined in a possibly resilient teeing portion (item 118 of FIG. 6) for securely receiving the ribs of the interface member 120 as will be apparent to one of ordinary skill in the art in view of this disclosure. In still other embodiments, the interface portion 120 may be removably received by the air relief hole 114 in various additional ways, for example, the interface portion may define one or more screw type threads (not shown) such that the retrieval portion 102 may be removably screwed into the grip hole 114.

In addition to simply picking up and otherwise manipulating a golf ball or other object, the retrieval and teeing device 102 of various embodiments of the present invention is also structured as a guide for users who wish to place a putting reference mark proximate the equator of the golf ball. For example, in one embodiment, the retrieval portion 116 of the retrieval and teeing device 102 may be pressed onto a golf ball 111 such that the peripheral edge 127 of the retrieval portion 116 is positioned generally proximate the equator of the golf ball 111. At least a portion of the peripheral edge 127 of the retrieval portion 116 is structured to define a continuous straight-edge such that a user may run a felt-tip marker or other appropriate marking device along the continuous strait-edge and thereby create a putting reference mark (not shown) proximate the equator of the golf ball 111.

Figure 8:
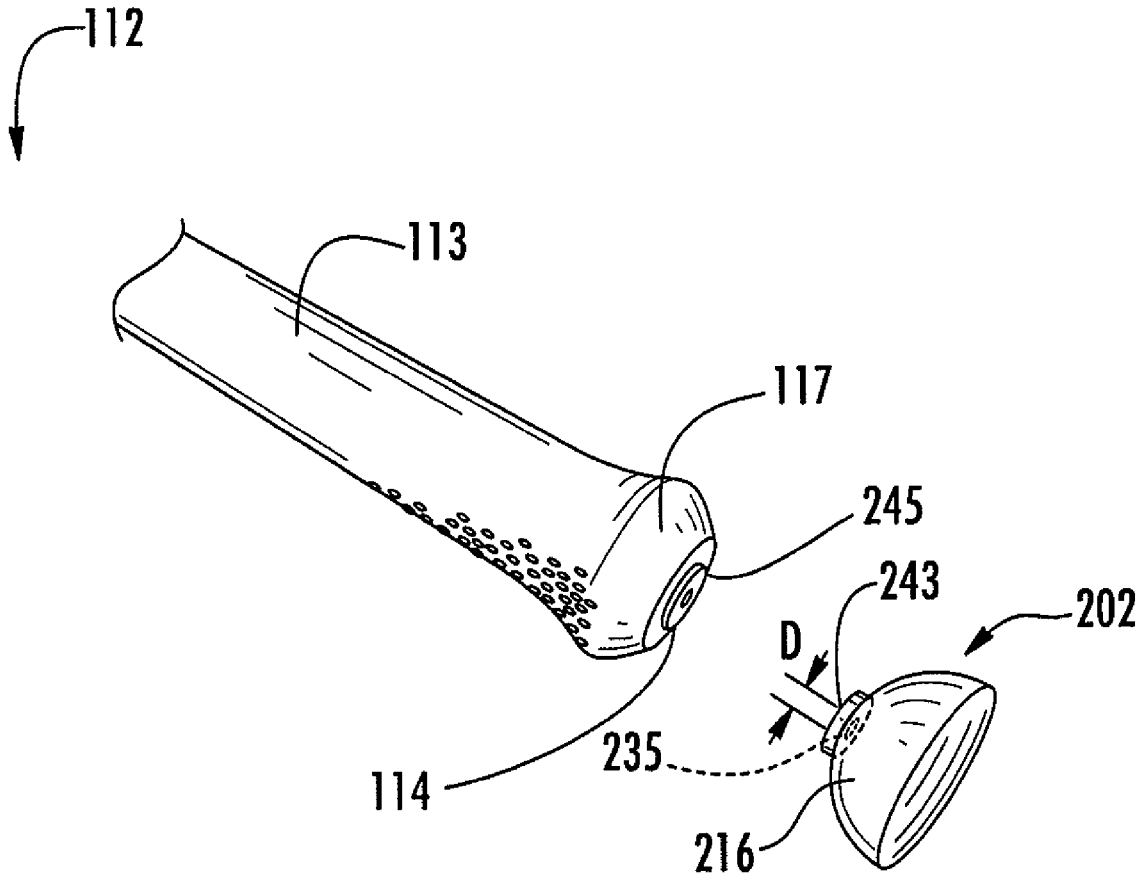
FIG. 8 is a perspective view of a golf ball retrieval and teeing device in accordance with another embodiment of the present invention.

Although previous embodiments of the present invention depict a retrieval and teeing device that is coupled to a golf club grip by the male/female interference fit between an elongate interference portion and a golf grip hole, retrieval and teeing devices structured in accordance with other embodiments may be coupled to a golf club grip in a variety of additional ways. For example, FIG. 8 illustrates a retrieval and teeing device 202 embodiment wherein an alternate golf grip coupling structure is used. The depicted retrieval and teeing device 202 includes a retrieval portion 216 that is structured similarly to the retrieval portion 116 described with respect to FIGS. 5-7; however, in the depicted embodiment, the interface portion/grip hole interface has been replaced with a durable, weather-resistant, hook-and-loop fabric fastener as is commonly known in the art.

For example, one might use a hook-and-loop fabric fastener of the type produced under the brand name VELCRO® by Velcro Industries B.V. The depicted hook-and-loop fabric fastener includes a first portion 243 comprised of a hook material and a second portion 245 comprised of a loop material. In the depicted embodiment, the first portion is attached to the retrieval portion 216 of the retrieval and teeing device 202 and the second portion is attached to the end 117 of a golf grip 113 as shown. In alternate embodiments, however, the relative attachment positions of the first and second portions 243, 245 of the hook-and-loop fastener may be reversed as will be apparent to one of ordinary skill in the art. In the depicted embodiment, the first and second portions 243, 245 of the hook-and-loop fastener are attached to their respective attachment surfaces by a pressure sensitive or contact adhesive. However, it should be noted that in other embodiments these components may be adhered in other ways such as by heat activated adhesives, staples, screws, nails, pop-rivets, or other fasteners.

Figure 9:
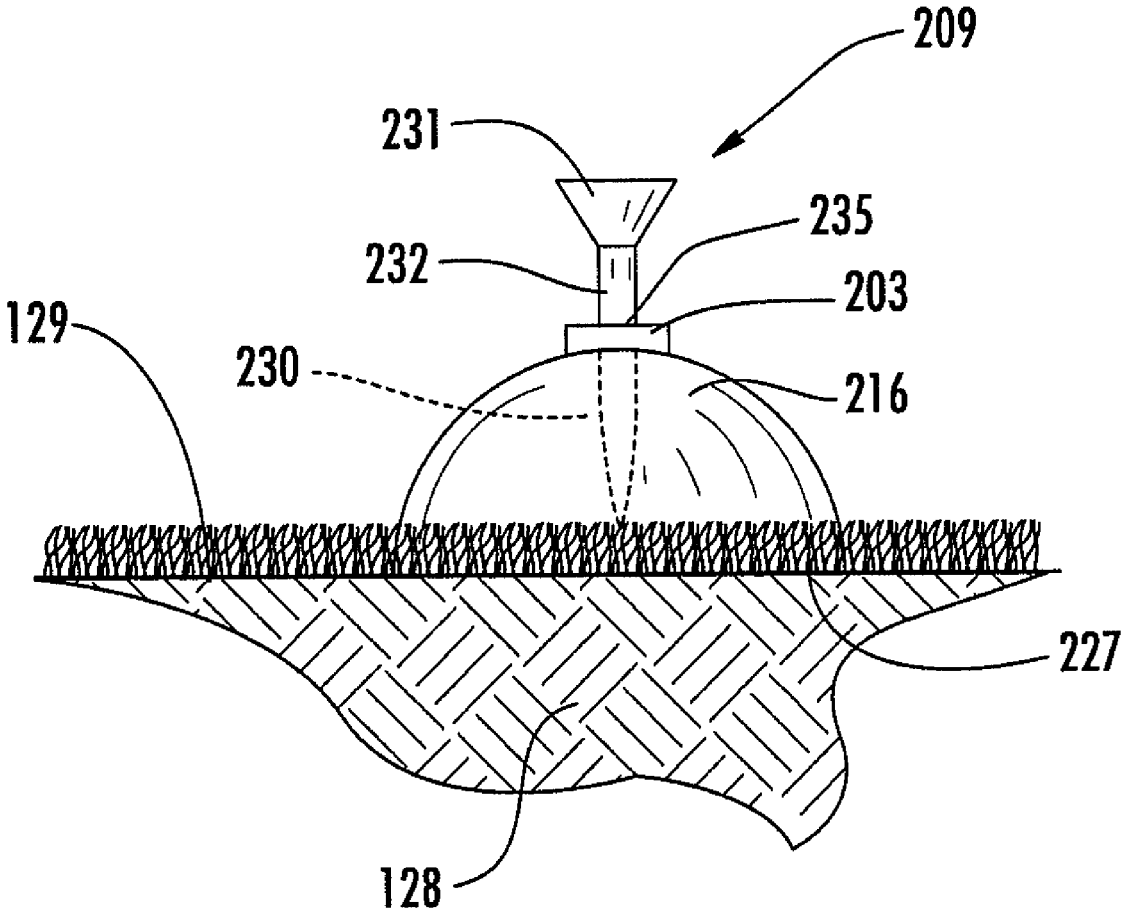
FIG. 9 is a front view of a golf ball retrieval and teeing device supporting a golf ball in a teeing position in accordance with another embodiment of the present invention.

FIG. 9 illustrates the teeing functionality of the retrieval and teeing device 202 shown in FIG. 8. In the depicted embodiment, the retrieval and teeing device 202 defines a hole 235 located generally adjacent the apex or top of the retrieval portion 216 as shown. In various embodiments, the hole 235 defines a diameter D that is approximately 0.1875 inches, more preferably between 0.125 and 0.25 inches, and still more preferably between 0.175 and 0.195 inches. In this regard, the hole 235 is structured to removably receive a shaft 230 of a conventional golf tee 232 as shown. In one embodiment, the hole 235 defined in the retrieval portion 216 is sized to produce a sliding interference fit with the shaft 230 of the golf tee 232. In this regard, the tee 232 may be held securely within the retrieval portion 216 for supporting a golf ball in a teed position (not shown). In various embodiments, the perimeter of the hole 235 may define one or more resilient slits, detents, or other features (not shown) for encouraging hole-size flexibility and thereby accommodating a secure interference fit at varying tee heights for tees having tapered shafts. In other embodiments, specialty tees (not shown) may be used having one or more ribs or other locating features defined on or about the tee shaft for securing the tee at a selected tee height within the hole 235.

Figure 10:
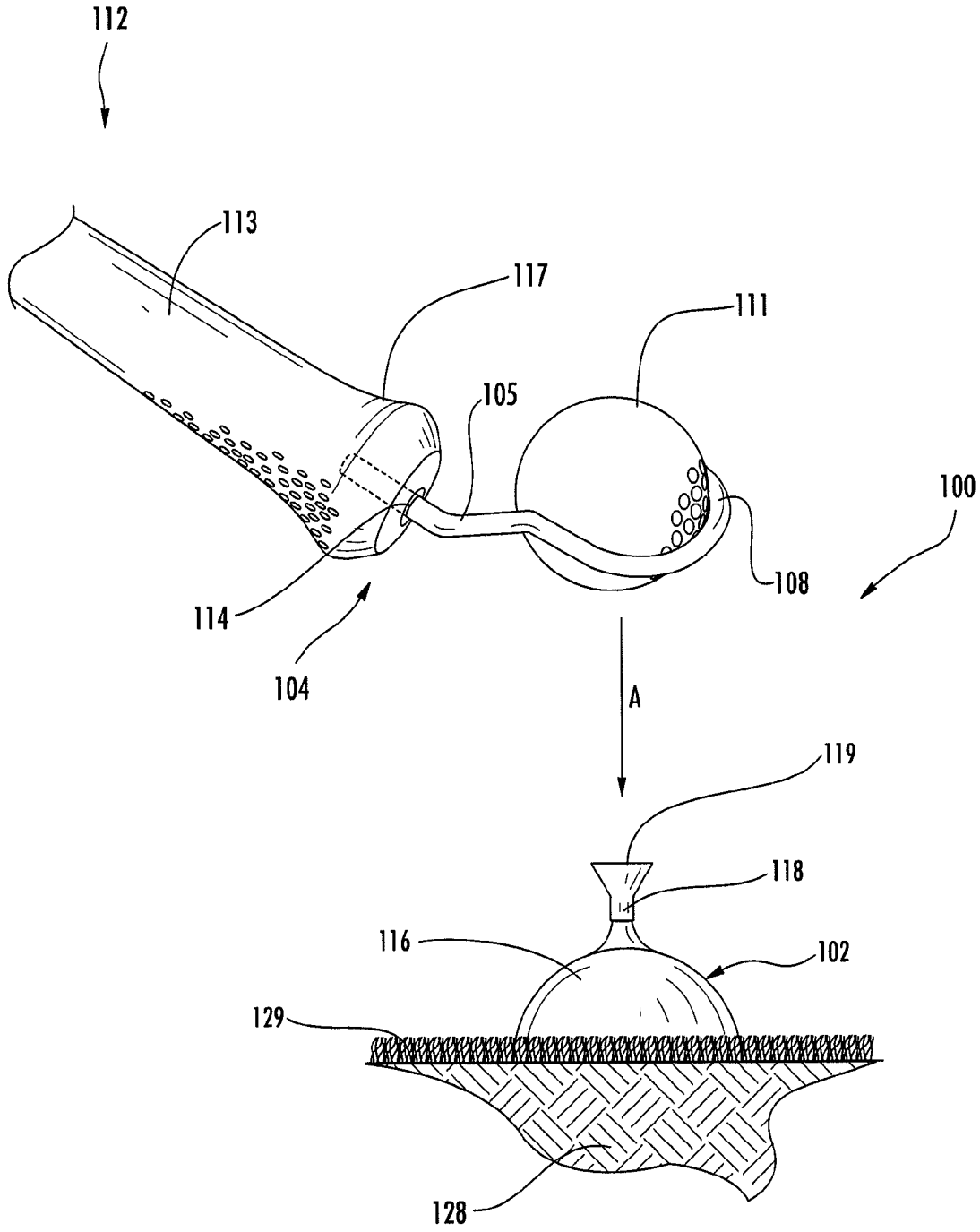
FIG. 10 is a perspective view of a golf ball positioning device being used to position a golf ball onto a golf ball retrieval and teeing device in accordance with one embodiment of the present invention.
Figure 12:
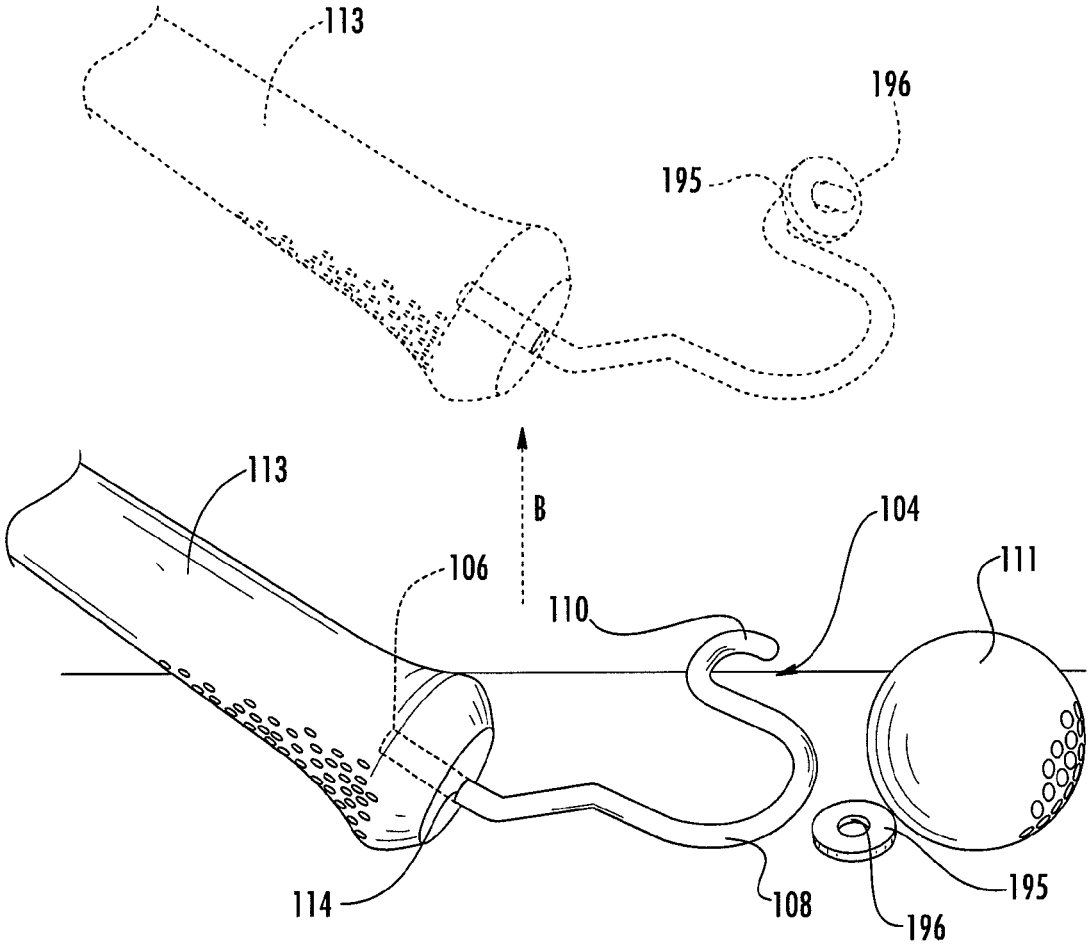
FIG. 12 is a perspective view of a golf ball positioning device inserted into the grip of a golf club and being used to position a ball marker in accordance with one embodiment of the present invention.

FIGS. 10, 11, and 12 depict usage of a golf ball retrieval and positioning system 100 structured in accordance with various embodiments of the present invention. For example, FIG. 10 depicts a positioning device 104 being used to position a golf ball 111 onto a retrieval and teeing device 102 in accordance with one embodiment of the present invention. The depicted positioning device 104 and retrieval and teeing device 102 are structured to be compact and therefore fit efficiently in a golfer's pocket or golf bag. Upon reaching a tee box, a golfer simply drops the retrieval and teeing device 102 proximate a desired teeing location and inserts the interface portion 106 of the positioning device 104 into the grip hole 114 of the golfer's driver. If the retrieval and teeing device 102 does not land on the ground in a tee-up position, with its retrieval portion 116 positioned squarely on the ground surface 129 and the teeing portion 118 in an upright position, the hook portion 110 of the positioning device 104 may be conveniently used to manipulate the teeing portion 118 of the retrieval and teeing device 104 into a tee-up position. As noted above, a golfer manipulates golf balls and other objects adjacent the ground without substantially bending over by grasping the head of the golf club and pointing the golf club grip and, thus, the positioning device 104, toward the object to that is to be manipulated. In the depicted embodiment, a golfer places a golf ball 111 into the cradle portion 108 of the positioning device 104, grasps the head of the golfer's driver, and lowers the positioning device 104 and golf ball 111 toward the teeing surface 119 of the retrieval and teeing device 102 generally along arrow A as shown. In this regard, the golf ball 111 is positioned onto the teeing portion 118 of the retrieval and teeing device 102 and made ready for driving as will be apparent to one of ordinary skill in the art.

Once a golfer has teed off, the golfer may pick up the retrieval and teeing device 102 using the hook portion 110 of the positioning device 104 as shown in FIG. 11. In particular, as noted above, the hook portion 110 of the positioning device 104 is sized to receive head of the teeing portion 118 of the retrieval and teeing device 102 thereby allowing a golfer to pluck the retrieval and teeing device 102 from the ground as shown.

Retrieval and teeing devices 202 structured in accordance with the embodiment depicted in FIGS. 8 and 9 may be used in a similar fashion to the retrieval and teeing device 102 depicted in FIG. 10. However, in such embodiments, a standard or specialty golf tee 232 is seated into the hole 235 defined in the retrieval portion 216 before the retrieval and teeing device 202 is dropped proximate a desired teeing location. The retrieval and teeing device 202 may then be manipulated into an upright position and a golf ball placed upon the golf tee 232 using the positioning device 104 as generally described above.

FIG. 12 depicts a positioning device 104 being used to mark the position of a golf ball 111 using a washer-shaped ball marker 195 in accordance with one embodiment of the present invention. Upon reaching a golf green, a golfer simply drops the washer-shaped ball marker 195 proximate the ball location and inserts the interface portion 106 of the positioning device 104 into the grip hole 114 of the golfer's club (e.g., wedge, putter, etc.). The golfer then grasps the head of the golf club and pushes the golf ball marker 195 into place behind the golf ball 111 using the hook portion 110 or outer edge of the cradle portion 108 of the positioning device 104. When it is time for the golfer to putt, the golfer may retrieve the golf ball marker 195 by inserting the hook portion 110 of the positioning device 104 into an aperture 196 defined in the golf ball marker 195 and withdrawing the marker 195 upwardly along arrow B as shown.

In another embodiment of the present invention a portion (e.g., the hook portion) of the positioning device 108 may be magnetized for use with a metallic golf ball marker 195. In such embodiments, the ball marker 195 could be manipulated into place on the ground using a non-magnetized portion (e.g., the cradle portion) of the positioning device 108 and retrieved using the magnetized portion of the positioning device 108.

Figure 13:
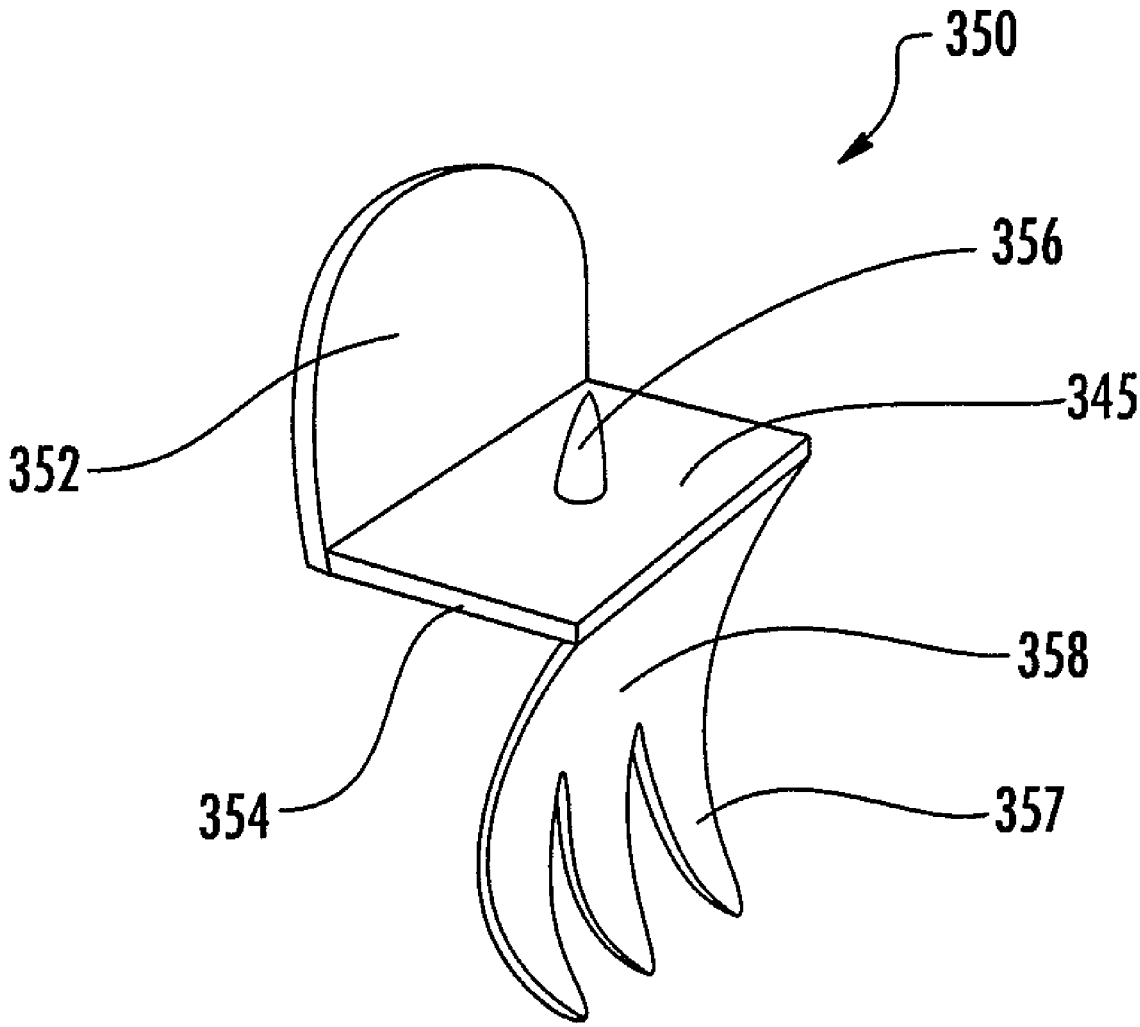
FIG. 13 is a perspective view of a ball mark repair device in accordance with one embodiment of the present invention.
Figure 14:
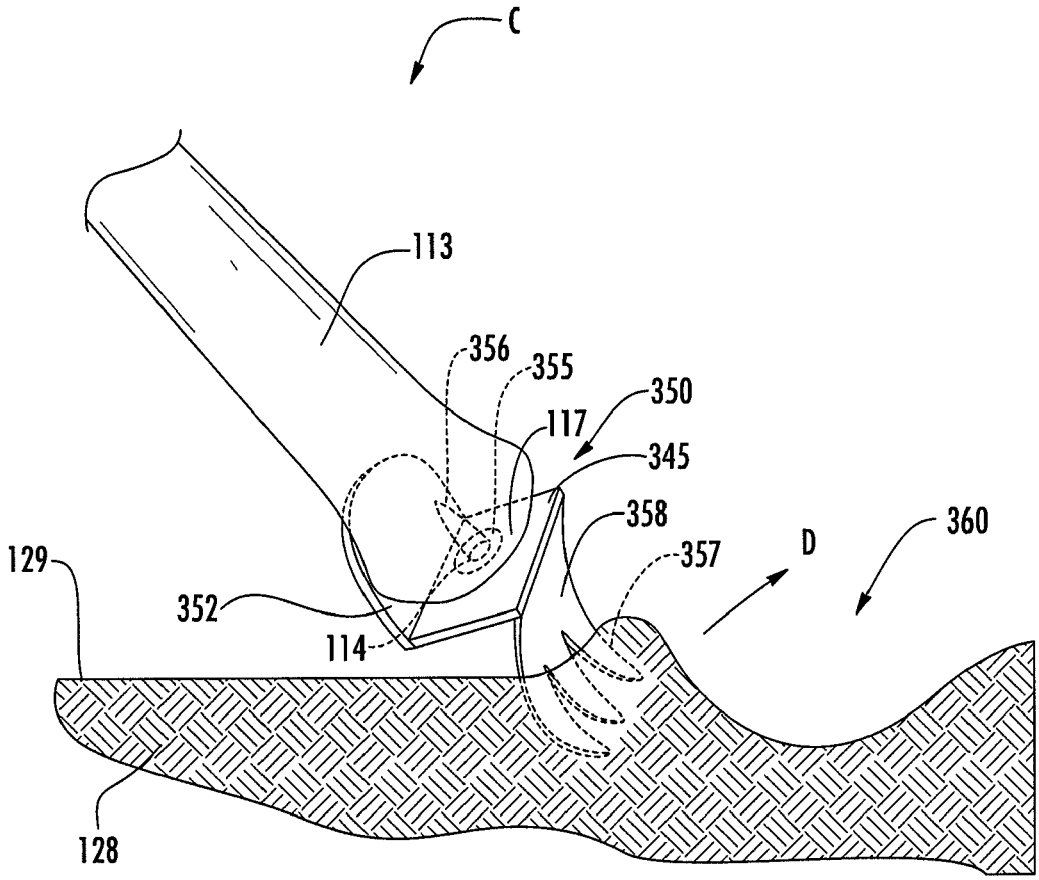
FIG. 14 is a perspective view of a ball mark repair device inserted into the grip of a golf club and being used to repair a ball mark in accordance with one embodiment of the present invention.

FIGS. 13 and 14 depict a ball mark repair device 350 structured in accordance with another embodiment of the present invention. The depicted ball mark repair device 350 may be alternatively referred to as a turf repair tool. For purposes of the present invention and appending claims the term "ball mark" refers to a divot, indentation, or other turf imperfection that occurs during golf as a result of impacts with the ground. Although most effective for repairing ball marks it will be apparent to one of ordinary skill in the art that ball mark repair devices structured in accordance with various embodiments of the present invention may also be used to repair divots created when a golfer swings a golf club or other turf imperfections.

The depicted ball mark repair device 350 includes a lever portion 352, a base portion 354, and a finger portion 358. The finger portion 358 includes at least one finger 357 that is adapted to be inserted into a putting green or any other surface having a ball mark 360 that a golfer wishes to repair. The depicted embodiment includes three fingers 357. The base portion 354 includes an interface portion 356 that is configured to be received by the air relief hole 114 of a conventional golf club grip 113, as similarly described above with respect to other embodiments of the present invention.

In the depicted embodiment, the interface portion/air relief hole interface also includes a durable, weather-resistant, hook-and-loop fabric fastener as generally described above. The depicted hook-and-loop fabric fastener includes a first portion 345 comprised of a hook material and a second portion 355 comprised of a loop material. In the depicted embodiment, the first portion 345 is attached to the base portion 354 of the ball mark repair device, and the second portion 355 is attached to the end 117 of a golf grip 113 as shown in FIG. 14 and as similarly described with respect to the embodiment depicted in FIG. 8.

FIG. 14 shows usage of the ball mark repair device 350 in accordance with various embodiments of the present invention. Upon reaching a putting green (or any other turf surface) having a ball mark 360 that a golfer desires to repair, the golfer simply inserts the interface portion 356 of the ball mark repair device 350 into the air relief hole 114 of the golfer's putter (or other golf club). Upon insertion of the interface portion 356 into the air relief hole 114, the first portion 345 of the hook and loop material engages the second portion 355 of the hook and loop portion material in order to secure the ball mark repair device 350 to the end 117 of the grip 113, and to keep the ball mark repair device 350 from rotating about the interface portion 356. Also, in this position, the lever portion 352 rests against a portion of the grip 113 adjacent the end 117 of the club as shown. The lever portion 352 is intended to provide leverage during usage of the ball mark repair device 350. Thus, in various embodiments, the lever portion 352 may take a variety of differing structures including structures that enhance the leverage provided by the lever portion 352. For example, in one embodiment the lever portion may define a curved region adapted to complement the curvature of the grip 113. In another embodiment, the lever portion may define a rib or other similar feature located at the top of the lever for creating an upwardly located contact point and thereby enhancing the leverage available when using the ball mark repair device.

A golfer manipulates the ball mark repair device 350 by grasping the head of a golf club and pointing the golf club grip 113 and, thus, the ball mark repair device 350, toward a ball mark 360 that is to be repaired. The golfer then inserts the fingers 357 of the ball mark repair device 350 into the ground 128 near the ball mark 360. The golf club is then moved against the lever portion along the direction generally defined by arrow C. When the golf club is moved in the direction of arrow C, the lever portion 354 of the ball mark repair device 350 provides leverage against the grip 113 such that the fingers 357 of the ball mark repair device 350 move in the direction generally defined by arrow D. This process may be repeated around the perimeter of the ball mark 360 as will be apparent to one of ordinary skill in the art. In this regard, the ball mark repair device 350 may be used by a golfer to repair a ball mark 360 without bending over.

In other embodiments, the ball mark repair device may be structured as set forth above; however, the interface portion 356 may be omitted. In such embodiments, the first portion of the hook and loop material would continue to engage the second portion of the hook and loop material thereby securing the ball mark repair device to the end of the golf club grip. The lever portion would therefor rest against a portion of the grip adjacent the end of the club as described above. In this regard, the lever portion would provide leverage for manipulating the tool during usage of the ball mark repair device. Should additional stability be required a more robust hook and loop material may be used. Alternatively, in other embodiments, a first end of a double-sided hook and loop strap may be affixed to the back surface of the lever portion (i.e., the surface opposite that which contacts the golf club grip). A second end of the double-sided hook and loop strap could then be wrapped around the golf club grip such that the double-sided hook and loop strap overlaps and thereby adheres to itself. In still other embodiments, the lever portion of the ball mark repair device may be formed to define a ring or partial ring that is structured to slideably receive the golf club grip as it is positioned to seat against the hook and loop surface of the first portion of the ball mark repair device.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A retrieval and teeing device that is configurable between a retrieval mode and a teeing mode and that is usable in combination with a golf club defining a first end and a second end, the retrieval and teeing device comprising:

a retrieval portion defining an arcuate body that is adapted to removably receive at least a portion of a golf ball in the retrieval mode, and wherein the retrieval portion defines an aperture;

a fastener comprising a first part and a second part, wherein the first part is affixed to the retrieval portion and the second part is affixed to the second end of the golf club, and wherein the first and second parts of the fastener are coupled together in the retrieval mode; and a tee comprising a tee body and a teeing surface, wherein the tee body is structured to be received within the aperture of the retrieval portion, and wherein the retrieval portion is configured to hold and support the tee body proximate a ground surface in the teeing mode such that the retrieval portion, tee body, and teeing surface are positioned substantially below the golf ball to support and present the golf ball above the ground surface as the golf ball is struck by a user swinging the golf club.

2. The retrieval and teeing device of claim 1, wherein the arcuate body of the retrieval portion defines a peripheral edge that is positionable adjacent the ground surface when the retrieval and teeing device is configured in the teeing mode.

3. The retrieval and teeing device of claim 1, wherein the arcuate body of the retrieval portion is generally hemispherical shaped and defines a continuous peripheral edge that is positionable proximate an equator of a golf ball for use as a guide when creating a putting reference mark.

4. The retrieval and teeing device of claim 1, wherein the arcuate body of the retrieval portion defines a cavity having a diameter that is less than 1.680 inches.

5. The retrieval and teeing device of claim 1, wherein the arcuate body of the retrieval portion defines a cavity having a diameter that is between 1.10 and 1.680 inches.

6. The retrieval and teeing device of claim 1, wherein the arcuate body of the retrieval portion defines a cavity having a diameter that is between 1.20 and 1.56 inches.

7. The retrieval and teeing device of claim 1, wherein the arcuate body of the retrieval portion defines a cavity that is sized to produce an interference fit with the at least a portion of the golf ball when the retrieval and teeing device receives the golf ball in the retrieval mode.

8. The retrieval and teeing device of claim 1, wherein the fastener comprises a hook and loop fabric.

9. A retrieval and teeing device that is configurable between a retrieval mode and a teeing mode and that is usable in combination with a golf club, the retrieval and teeing device comprising:

a retrieval portion defining a cavity that is sized to receive at least a portion of a golf ball, wherein the retrieval portion is coupled to the golf club in the retrieval mode, and wherein the retrieval portion is not coupled to the. golf club and is instead disposed proximate a ground surface in the teeing mode; and a tee adapted to be removably coupled to the retrieval portion, wherein the retrieval portion is configured to support the tee proximate the ground surface when coupled to the tee so swinging the golf club when the retrieval and teeing device is configured in the teeing mode.

10. The retrieval and teeing device of claim 9, wherein the cavity of the retrieval portion defines a peripheral edge that is positionable adjacent the ground surface in the teeing mode.

11. The retrieval and teeing device of claim 9, wherein the cavity of the retrieval portion defines a peripheral edge that is positionable proximate an equator of the golf ball for use as a guide when creating a putting reference mark.

12. The retrieval and teeing device of claim 9, wherein the cavity is sized to produce an interference fit with the at least a portion of the golf ball when the retrieval and teeing device receives the golf ball in the retrieval mode.

* * * * *

UNITED STATES PATENT AND TRADEMARK OFFICE

CERTIFICATE OF CORRECTION

PATENT NO. : 7,390,268 B2
APPLICATION NO. : 11/384661
DATED : June 24, 2008
INVENTOR(S) : Merriman It is certified that error appears in the above-identified patent and that said Letters Patent is hereby corrected as shown below:

Column 12, Claim 9 should read,

--17. A retrieval and teeing device that is configurable between a retrieval mode and a teeing mode and that is usable in combination with a golf club, the retrieval and teeing device comprising:

a retrieval portion defining a cavity that is sized to receive at least a portion of a golf ball, wherein the retrieval portion is coupled to the golf club in the retrieval mode, and wherein the retrieval portion is not coupled to the golf club and is instead disposed proximate a ground surface in the teeing mode; and a tee adapted to be removably coupled to the retrieval portion, wherein the retrieval portion is configured to support the tee proximate the ground surface when the retrieval and teeing device is configured in the teeing mode, wherein the golf ball is able to be positioned on the tee substantially above the retrieval portion disposed proximate the ground surface in the teeing mode and thereby presented for striking by a user swinging the golf club.--

Signed and Sealed this

Twenty-sixth Day of August, 2008

JON W. DUDAS
*Director of the United States Patent and Trademark Office*

UNITED STATES PATENT AND TRADEMARK OFFICE

CERTIFICATE OF CORRECTION

PATENT NO. : 7,390,268 B2
APPLICATION NO. : 11/384661
DATED : June 24, 2008
INVENTOR(S) : Merriman It is certified that error appears in the above-identified patent and that said Letters Patent is hereby corrected as shown below:

Column 12, Claim 9, lines 1-16, should read,

--9. A retrieval and teeing device that is configurable between a retrieval mode and a teeing mode and that is usable in combination with a golf club, the retrieval and teeing device comprising:

a retrieval portion defining a cavity that is sized to receive at least a portion of a golf ball, wherein the retrieval portion is coupled to the golf club in the retrieval mode, and wherein the retrieval portion is not coupled to the golf club and is instead disposed proximate a ground surface in the teeing mode; and a tee adapted to be removably coupled to the retrieval portion, wherein the retrieval portion is configured to support the tee proximate the ground surface when the retrieval and teeing device is configured in the teeing mode, wherein the golf ball is able to be positioned on the tee substantially above the retrieval portion disposed proximate the

UNITED STATES PATENT AND TRADEMARK OFFICE

CERTIFICATE OF CORRECTION

PATENT NO. : 7,390,268 B2
APPLICATION NO. : 11/384661
DATED : June 24, 2008
INVENTOR(S) : Merriman It is certified that error appears in the above-identified patent and that said Letters Patent is hereby corrected as shown below:

ground surface in the teeing mode and thereby presented for striking by a user swinging the golf club.--

This certificate supersedes the Certificate of Correction issued August 26, 2008.

Signed and Sealed this

Twenty-third Day of September, 2008

JON W. DUDAS
*Director of the United States Patent and Trademark Office*